US011691311B2

(12) United States Patent
Watson

(10) Patent No.: US 11,691,311 B2
(45) Date of Patent: Jul. 4, 2023

(54) SAW GUARD AND METHODS OF USE THEREOF

(71) Applicant: Benjamin K. Watson, Ogden, UT (US)

(72) Inventor: Benjamin K. Watson, Ogden, UT (US)

( * ) Notice: Subject to any disclaimer, the term of this patent is extended or adjusted under 35 U.S.C. 154(b) by 0 days.

(21) Appl. No.: 17/394,659

(22) Filed: Aug. 5, 2021

(65) Prior Publication Data

US 2023/0039598 A1 Feb. 9, 2023

(51) Int. Cl.
*B27G 19/02* (2006.01)
*B27G 19/08* (2006.01)

(52) U.S. Cl.
CPC ..... *B27G 19/02* (2013.01); *B27G 19/08* (2013.01); *Y10T 83/732* (2015.04); *Y10T 83/773* (2015.04); *Y10T 83/7734* (2015.04)

(58) Field of Classification Search
CPC ..... B23D 51/10; B23D 51/16; B25F 5/006; B27B 19/09; B26B 27/005; B27G 19/02
USPC ..... 30/2, 278, 279.2
See application file for complete search history.

(56) References Cited

U.S. PATENT DOCUMENTS

D292,407 S 10/1987 Legler et al.
4,721,023 A 1/1988 Bartlett et al.
D298,040 S 10/1988 Legler et al.
5,231,906 A * 8/1993 Kogej ..... B23D 47/025 83/544
D393,473 S 4/1998 Ramirez
D394,071 S 5/1998 Ceroll et al.
D444,485 S 7/2001 Ceroll et al.
D513,272 S 12/2005 Phillips et al.
7,210,386 B1 * 5/2007 Chang ..... B23D 47/025 83/DIG. 1
D554,672 S 11/2007 Welsh et al.
7,302,878 B2 * 12/2007 Chang ..... B27G 19/10 83/477.2
D586,371 S 2/2009 Leasure et al.
7,600,456 B2 * 10/2009 Burke ..... B23D 47/04 83/477.2

(Continued)

FOREIGN PATENT DOCUMENTS

CN 201086158 Y * 7/2008
EP 2603344 B1 5/2017
WO 2020148146 A1 7/2020

OTHER PUBLICATIONS

CN-201086158-Y English Translation; Jul. 2008; Xhuang B.*

*Primary Examiner* — Laura M Lee
(74) *Attorney, Agent, or Firm* — Dorsey & Whitney LLP

(57) ABSTRACT

A saw guard for attachment to a riving knife of a table saw includes a body portion having an elongated shape. The body portions defines a guard portion configured to cover a portion of a saw blade and an attachment portion. The attachment portion extends from the guard portion and defines a slot configured to receive the riving knife. The saw guard further includes an anchor piece connected to the body portion and arranged at least partially in the slot. The saw guard further includes an attachment assembly connected to the body portion and arranged at least partially in the slot and separated from the anchor piece. In a first configuration, the anchor piece and the attachment assembly may define a two-point attachment between the saw guard and the riving knife. In a second configuration, the attachment assembly may permit release of the saw guard from the riving knife.

18 Claims, 13 Drawing Sheets

(56) References Cited

U.S. PATENT DOCUMENTS

| | | | | |
|---|---|---|---|---|
| 8,096,220 | B2 | 1/2012 | Weir et al. | |
| 8,424,434 | B2 * | 4/2013 | Koegel | B27B 27/08 83/477 |
| 10,252,444 | B2 * | 4/2019 | Hart | B28D 1/04 |
| 10,688,572 | B2 | 6/2020 | Fulmer et al. | |
| 10,882,207 | B2 | 1/2021 | Gass et al. | |
| 2004/0226424 | A1 | 11/2004 | Obanion et al. | |
| 2007/0157784 | A1 | 7/2007 | Gass et al. | |
| 2012/0216665 | A1 * | 8/2012 | Gass | B27B 5/29 83/440.2 |
| 2014/0216224 | A1 * | 8/2014 | Bernhardt | B27G 19/08 83/169 |
| 2016/0332244 | A1 * | 11/2016 | Koegel | B23Q 17/2419 |
| 2020/0307016 | A1 * | 10/2020 | Tsuda | B27G 19/08 |

* cited by examiner

SAW GUARD AND METHODS OF USE THEREOF

FIELD

The described examples relate generally to saw guard for a table saw.

BACKGROUND

A saw guard may be arranged to partially cover a saw blade of a table saw. The saw guard may shield an operator from dust and debris from a cutting operation. The saw guard may also define a path for dust output from the cutting operation to a vacuum or other device. Conventional saw guards are often cumbersome and/or lack the ability to readily attach and detach from the table saw in an efficient and/or ergonomic manner. Conventional saw guards may also include a collection of components that may hinder a cutting operation, for example, by moving during a cutting operation and/or occupying a large footprint around the saw blade. As such, there is a need for systems and techniques that enhance saw guard functionality.

SUMMARY

Examples of the present invention are directed to a saw guard and associated systems and methods of use thereof.

In one example, a saw guard is disclosed for attachment to a riving knife of a table saw. The saw guard includes a body portion having an elongated shape and defining a guard portion configured to cover a portion of a saw blade. The body portion further includes an attachment portion extending from the guard portion and defining a slot configured to receive a portion of the riving knife. The saw guard further includes an anchor piece connected to the body portion and arranged at least partially in the slot. The saw guard further includes an attachment assembly connected to the body portion and arranged at least partially in the slot and separated from the anchor piece. In a first configuration, the anchor piece and the attachment assembly define a two-point attachment between the saw guard and the riving knife. Further, in a second configuration, the attachment assembly permits release of the saw guard from the riving knife.

In another example, the attachment assembly may include a moveable anchor piece that extends into the slot. In the first configuration, the moveable anchor piece may extend across a complete width of the slot. Further, in the second configuration, the moveable anchor piece may be moved such that the slot is free of the moveable anchor piece. The attachment assembly may further include a biasing member configured to maintain the moveable anchor piece in the first configuration. The attachment assembly may further include an engagement feature connected to the moveable anchor piece. The attachment assembly may be configured to receive a user input that overcomes a biasing force of the biasing member and permits the movement of the moveable anchor piece from the first configuration to the second configuration.

In another example, the slot may be defined extending in an elongated direction along an underside of the body portion. In this regard, the attachment portion may include a forward attachment section recessed on the underside of the body portion. The attachment portion may further include a rear attachment section defining a bottommost surface of the body portion adjacent the forward attachment section. The slot may therefore be defined extending along the forward attachment section and the rear attachment section. In some cases, the anchor piece extends across a width of the slot at the rear attachment section. Accordingly, the attachment assembly may include a moveable anchor that extends across a width of the slot at the forward attachment section.

In another example, the body portion may define, at the guard portion, an outer contoured surface configured to match a generally circular shape of the saw blade. In some cases, the outer contoured surface may include a beveled surface extending along the generally circular shape of the saw blade.

In another example, the guard portion may define a guard cavity configured to receive the portion of a saw blade. The body portion may further define a vacuum portion extending from the guard portion that is configured to define an exit for dust produced in the guard cavity by operation of the saw blade. The vacuum portion may be configured for attachment with tubing of a vacuum system. The vacuum portion may define a substantially cylindrical opening configured to receive a tube of the vacuum system. The vacuum portion may be configured to form a friction fit with the tube of the vacuum systems received in the substantially cylindrical opening.

In another example, a system is disclosed. The system include a saw guard, such as any of the saw guards described herein. The system further includes a gauge configured to define a separation between the saw guard and a table of the table saw.

In another example, the gauge includes a lip configured to contact the saw guard and set a clearance between the saw guard and the table saw. The system may further include a riving knife. In this regard, the riving knife may include a first attachment feature configured to receive the anchor piece. The riving knife may further include a second attachment feature configured to receive a moveable anchor piece of the attachment assembly. The first and second attachment features are defined by grooves extending through a thickness of the riving knife.

In another example, the system further includes a table saw.

In another example, a method of attaching a saw guard to a riving knife of a table saw is disclosed. The method includes providing a saw guard, such as any of the saw guard described herein. The method further includes manipulating the attachment assembly from a first configuration into a second configuration, such as the first and second configurations described herein. The method further includes causing the slot to receive the portion of the riving knife. The method further include releasing the attachment assembly such that the attachment assembly returns to the first configuration and secures the saw guard to the portion of the riving knife.

In addition to the exemplary aspects and embodiments described above, further aspects and embodiments will become apparent by reference to the drawings and by study of the following description.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1A:
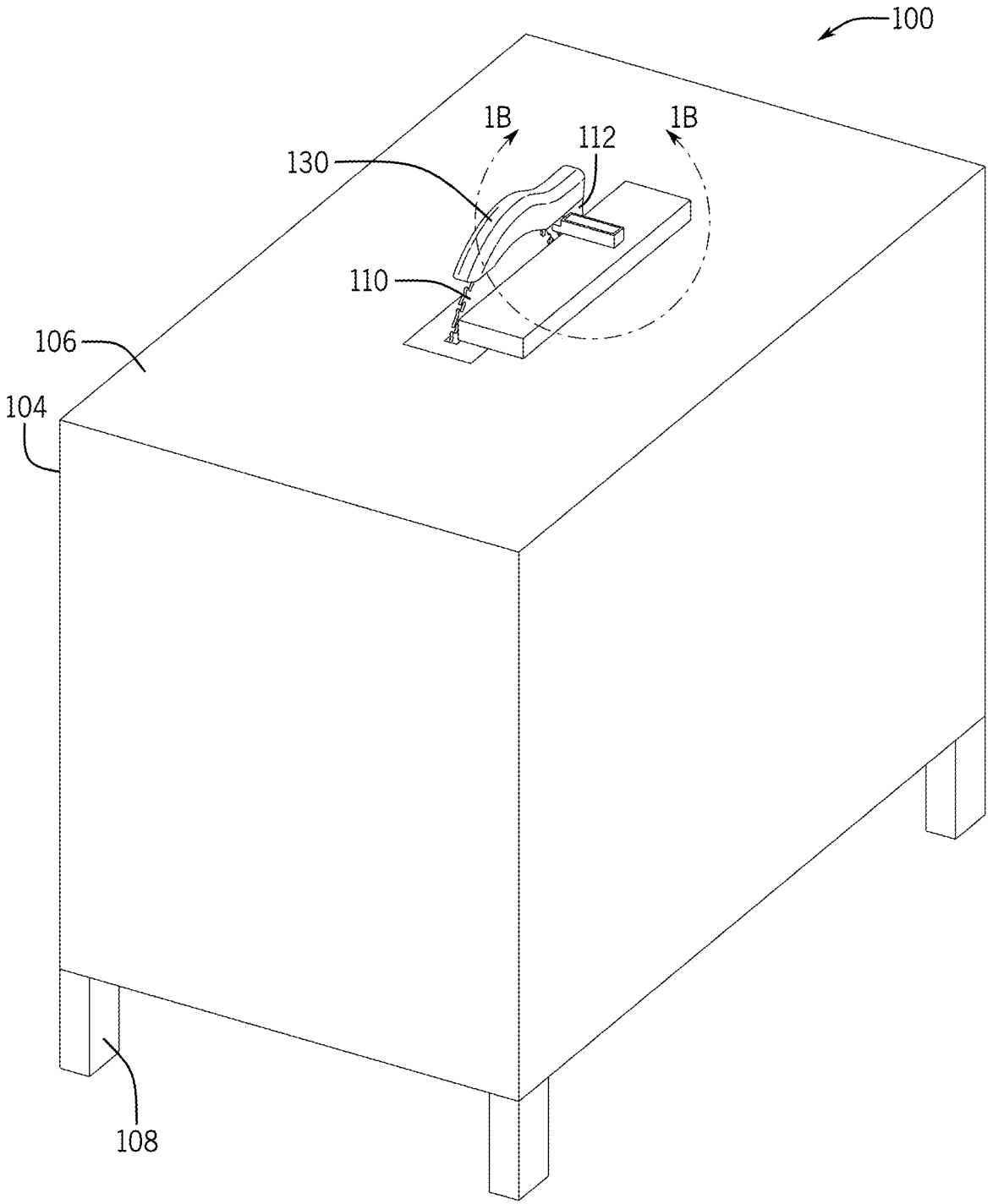
FIG. 1A depicts an isometric view of a first embodiment of a saw guard connected to a riving knife of a saw table.

The description that follows includes sample systems, methods, and apparatuses that embody various elements of the present disclosure. However, it should be understood that the described disclosure may be practiced in a variety of forms in addition to those described herein.

The following disclosure relates generally to saw guards and associated systems and methods of use thereof. A table saw may be used to perform a cutting operation that cuts certain objects, such as various types of wood. The cutting operation may produce dust, debris, wood chips, and so on, which could detract from operator safety. The operation of the saw blade may also detract from operator safety, as an exposed saw blade may present a risk of injury to the operator. A saw guard may be arranged to partially cover the saw blade to shield the operator from the saw blade and more generally the outputs from the sawing operation, such as dust and debris. Conventional saw guards are often cumbersome and lack the ability to readily attach and detach from the table saw in an efficient and/or ergonomic manner. Conventional saw guards may also include a collection of components that may hinder a cutting operation, for example, by moving during a cutting operation and/or occupying a disproportionately large footprint around the saw blade.

The systems and techniques of the present disclosure may mitigate such hindrances, in part, by providing a saw guard that releasably attaches to a riving knife of a table saw. Broadly, a riving knife is often associated with a saw blade of a table saw to support, among other functions, maintaining an even gap between two portions of a cut board (e.g., to mitigate kickback, jamming, and so on). The riving knife may be positionally fixed relative to the saw blade and adjustable in height relative to a table portion of the table saw. The saw guard of the present disclosure may be configured for releasable attachment to the riving knife of the table saw such that the saw guard is positionally fixed relative to the riving knife. In this manner, a height of the saw guard, the riving knife, the saw blade may be adjusted together (e.g., to accommodate a height of a particular board or other object to be sawed). During the cutting operation, the saw guard may be stationary and provide consistent shielding of dust and debris. The saw guard may be releasably coupled to the riving knife such that the saw guard may be decoupled from the riving knife and stored for later use when the cutting operations ends.

To facilitate the foregoing, the saw guard may include a body portion and have an elongated shape defining a guard portion and an attachment portion. The body portion may have an integral or one-piece construction. The body portion may be formed from a plastic material, such a material used in a three-dimensional printing operation. Injection molding and other techniques may be used to form the body portion. The guard portion may be configured to cover a portion of the saw blade. The attachment portion may extend integrally from the guard portion and define a slot that is configured to receive a portion of the riving knife.

The saw guard may include various components that cooperate to define a two-point attachment between the saw guard and riving knife. For example, the saw guard may include an anchor piece connected to the body portion and arranged at least partially in the slot. For example, the anchor piece may include a cylindrical piece of metal construction that spans a width of the slot. The saw guard may further include an attachment assembly that is connected to the body portion and arranged at least partially in the slot and separated from the anchor piece. As described herein, the attachment assembly may include a spring-biased movable anchor piece. In this regard, in a first configuration, the anchor piece and the attachment assembly may define a two-point attachment between the saw guard and the riving knife. In a second configuration, the attachment assembly may permit the release of the saw guard from the riving knife, for example, by manipulation of spring-biased moveable anchor piece.

In some examples, the saw guard may be configured for attachment to a vacuum system. For example, the guard portion may define a guard cavity configured to receive a portion of the saw blade. The body portion may in turn define a vacuum portion extending from the guard portion that is configured to define an exit for dust produced in the guard cavity by the operation of the saw blade. While many constructions are possible and contemplated herein, the vacuum portion may include a substantially cylindrical tube that extends from the guard cavity. The cylindrical tube may be configured to define a friction fit or otherwise physically couple with a tubing of a vacuum system.

Reference will now be made to the accompanying drawings, which assist in illustrating various features of the present disclosure. The following description is presented for purposes of illustration and description. Furthermore, the description is not intended to limit the inventive aspects to the forms disclosed herein. Consequently, variations and modifications commensurate with the following teachings, and skill and knowledge of the relevant art, are within the scope of the present inventive aspects.

FIG. 1A depicts a system 100 including a saw guard 130 attached to a riving knife 112 of a table saw 104. The table saw 104 may be substantially any table saw that is configured to perform a cutting operation. For example, the table saw 104 may be a woodworking saw that is configured to cut various wood components, including wood boards. The saw guard 130 described herein may be configured for attachment with substantially any table saw that includes or is associated with a riving knife. For purposes of illustration, the table saw 104 of FIG. 1A includes a table portion 106, supports 108, and a saw blade 110. The table portion 106 may broadly refer to a collection of components, assembly, subassemblies, and so on that facilitate the cutting operations described herein. By way of non-limiting illustration, the table portion 106 may include a base, a table top, a table extension, wings, rip fence, rails, a miter gauge, a motor, trunnions, an arbor assembly, and so on. The supports 108 shown in FIG. 1A include a collection of four legs. In other cases, other supports may be used. The table saw 104 may be portable or otherwise readily moveable between various different locations. The saw blade 110 is shown as a circular saw blade, which may be mounted via the arbor assembly or other component of the table portion 106.

Figure 1B:
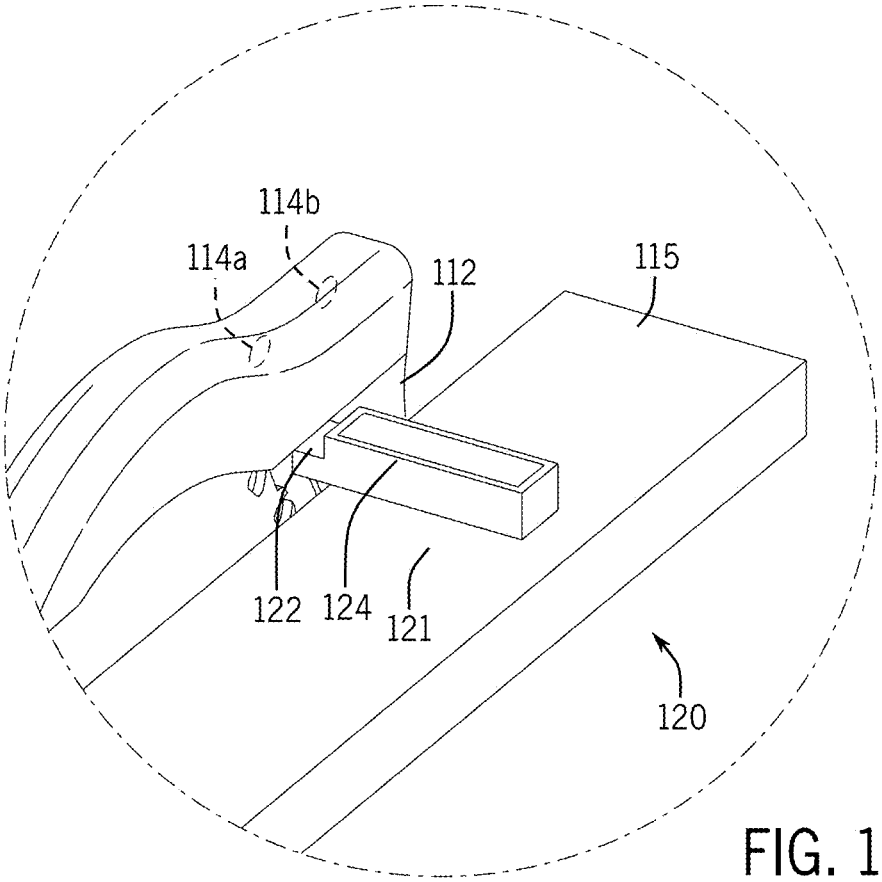
FIG. 1B depicts detail 1B-1B of FIG. 1, including the saw guard and a gauge.

With reference to FIGS. 1A and 1B, the table saw 104 may also include a riving knife 112. The riving knife 112 may be used to support maintaining an even gap between two portions of a cut board (e.g., to mitigate kickback, jamming, and so on). The riving knife may be positionally fixed relative to the saw blade and adjustable in height relative to a table portion of the table saw. As shown in FIG. 1B, the riving knife 112 may include at least a first attachment feature 114*a* and a second attachment feature 114*b*. The first and second attachment features 114*a*, 114*b* may be grooves or other features that are formed in or defined by the riving knife 112. The first and second attachment features 114*a*, 114*b* may be configured for engagement with complimentary features of the saw guard to facilitate the releasable attachment of the saw guard 130 to the riving knife 112.

Broadly, the saw guard 130 may be configured for two-point, releasable attachment to the riving knife 112. For purposes of illustration, FIG. 1B shows the saw guard 130 a first attachment point (e.g., at the first attachment feature 114*a*) and a second attachment point (e.g., at the second attachment feature 114*b*). The saw guard 130 may be attached to the riving knife 112 at the first and second attachment points in order to define the two-point attachment described herein. For example, the saw guard 130 may include various anchor pieces, fasteners, attachment assemblies and so that are generally arranged at one or both of the first and second attachment points for mechanical engagement with the first and second attachment features 114*a*, 114*b*.

The two-point attachment of the saw guard 130 to the riving knife 112 may help stabilize a position of the saw guard 130. For example, the saw guard 130 may generally be positionally fixed relative to the riving knife 112 upon attachment of the saw guard 130 to the riving knife 112 at the first and/or second attachment features 114*a*, 114*b*. As described herein, the riving knife 112 may be moved with the height of the saw blade 110, for example, to adjust for a height of the component to be cut. In this regard, a height of the saw guard 130 relative to a tabletop of the table portion 106 may also be adjusted with the adjustment to the riving knife 112/saw blade 110. A height of the saw guard 130 may be maintained during a cutting operation to provide a consistent shield between the saw blade 110/debris and the operator. Further, by maintaining a consistent position of the saw guard 130, the operator may focus on the cutting operation rather than, for example, the placement of the saw guard 130.

In some cases, it may be desirable to set the saw guard 130 at a predetermined height from the working piece, such as the board 115 shown in FIG. 1B. For example, a bottom edge of the saw guard 130 may be offset at clearance from a top of the board 115 by a predetermined value, such as around 5 mm, around 10 mm or other value. Accordingly, the system 100 may further include a gauge 120, shown in FIG. 1B. The gauge 120 may include a gauge body 121 having a lip 122. A reinforcement plate 124 may span a longitudinal dimension of the gauge 120. The lip 122 may have a height corresponding to the height of the desired predetermined clearance. Accordingly, the operator may place the gauge 120 on the working piece and adjust the height of the riving knife 112/saw guard 130 so that the bottom edge of the saw guard 130 contacts the lip 122. The gauge 120 may subsequently be removed and thus the saw guard 130 is set at the desired clearance from the working piece 115.

Figure 2:
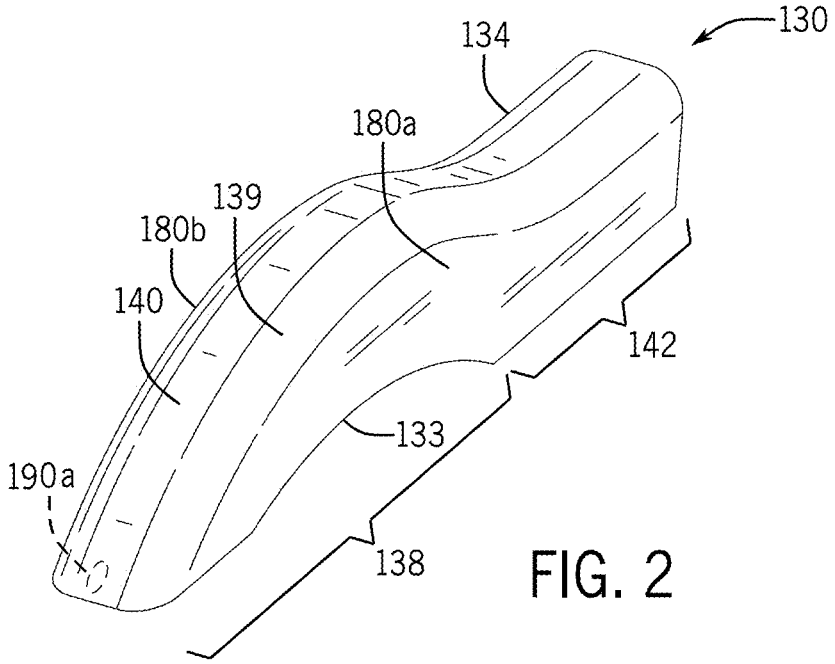
FIG. 2 depicts a top isometric view of the saw guard of FIG. 1 with the riving knife and saw table removed.
Figure 3:
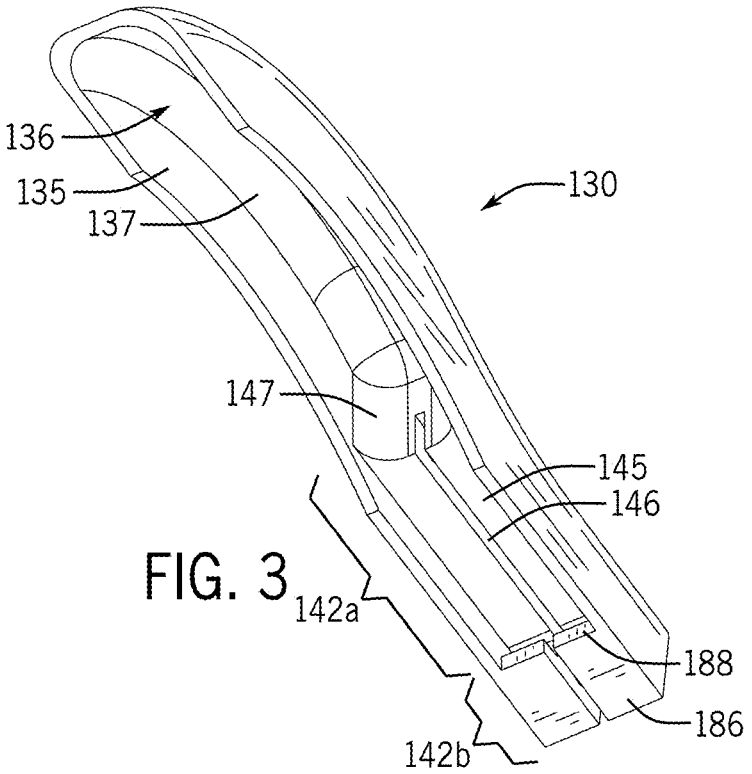
FIG. 3 is a bottom isometric view of the saw guard of FIG. 2 in an exploded configuration.
Figure 3A:
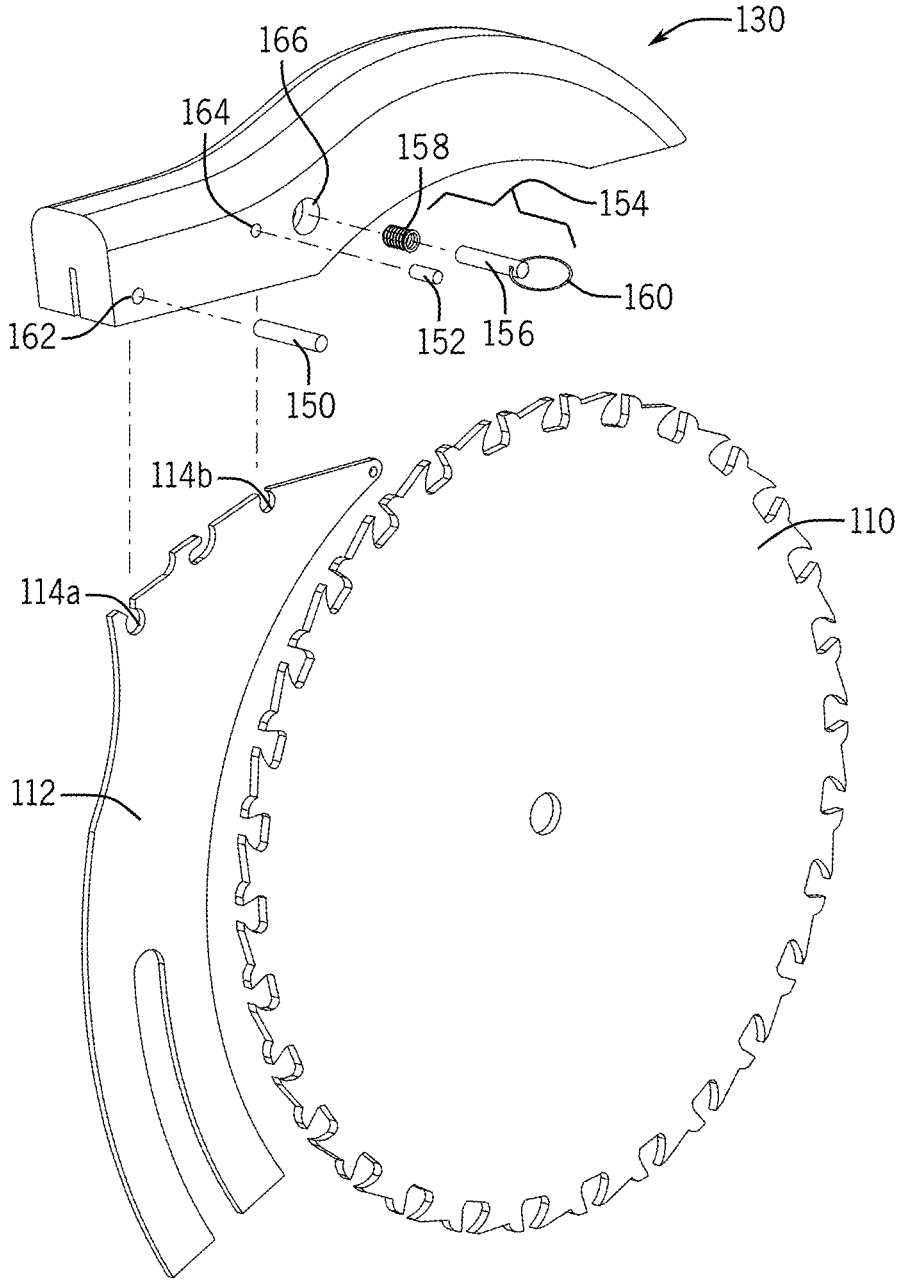
FIG. 3A is an exploded view of the saw guard of FIG. 3.
Figure 4:
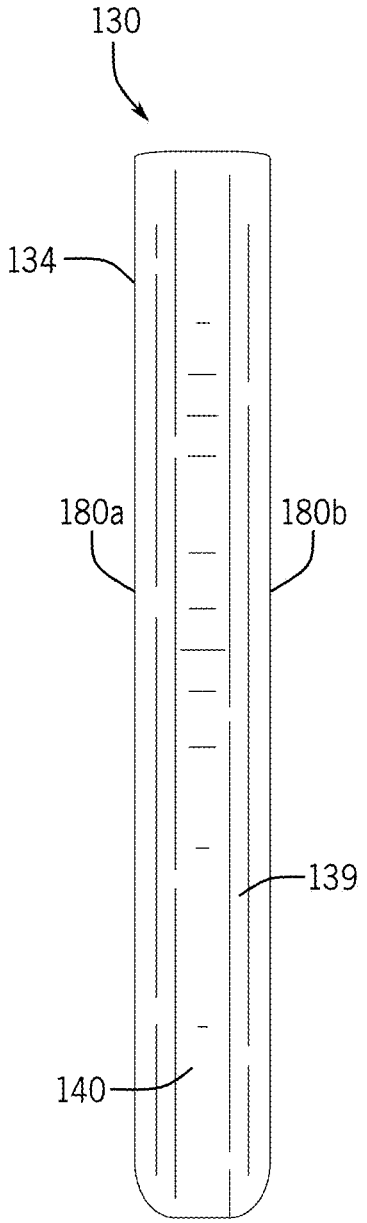
FIG. 4 is a top plan view of the saw guard of FIG. 2.

With reference to FIGS. 2 and 3, the saw guard 130 may include a body portion 134. The body portion 134 may have an integral or one-piece construction. In other cases, the body portion 134 may include a collection of components attached to one another. The body portion may be formed from a plastic material, such a material used in a three-dimensional printing operation. Injection molding and other techniques may be used to form the body portion. The body portion 134 may have an elongated shape that extends along the saw blade 110 and the riving knife 112, covering at least a portion thereof. As described further below, the body portion 134 may be configured to conform or match to one or more contours of the table saw 104, such as the substantially circular contour of the saw blade 110.

The body portion 134 is broadly shown in FIG. 2 as including a guard portion 138 and an attachment portion 142. The guard portion 138 may be configured to cover a portion of the saw blade 110. The attachment portion 142 may extended integrally from the guard portion 138 and be configured to receive a portion of the riving knife 112. For example, and as shown in FIG. 3, the attachment portion 142 may define or include a slot 146 that is configured to receive the portion of the riving knife 112 for attachment to the saw guard 130.

Various features of the body portion 134 may define sections of one or both of the guard portion 138 and/or the attachment portion 142, described in turn below. As illustrated in FIGS. 2 and 3, the body portion 134 may include a first side wall portion 180*a* and second side wall portion 180*b*. The first and second sidewall portions 180*a*, 180*b* may generally form sidewalls of the saw guard 130 that run substantially perpendicular to the saw blade 110 and riving knife 112 when the saw guard 130 is attached to the riving knife 112. The first and second sidewalls 180*a*, 180*b* may form a continuous sidewall for both the guard portion 138 and the attachment portion 142. Each of the first and second sidewalls portions 180*a*, 180*b* may have a flat exterior contour; however this is not required. The first and second sidewall portions 180*a*, 180*b* may also include a cutaway 133. The cutaway 133 may be defined as a semi-circular concave cut from a bottommost edge of the first and second sidewall portions 180*a*, 180*b*. The cutaway 133 may be arranged at the guard portion 138. The cutaway may be configured to generally be aligned with an axis of rotation of the saw blade 110 when the saw guard 130 is attached to the riving knife 112.

The body portion 134 may further include a top wall 139. The top wall 139 may be a contoured wall that is attached to each of the first and second sidewalls 180*a*, 180*b*. The top wall 139 may be a contoured exterior surface of the saw guard 130. For example, the top wall 139 may generally have a shape, at the guard portion 138, that follows a contour of the saw blade 110, such as the substantially circular contour described above. In some cases, as shown in FIGS. 2 and 3, the top wall 139 may include a beveled edge 140. The beveled edge 140 may be a generally flat contour of the top wall 139. The beveled edge 140 may extend from a forward most portion of the body portion 134 to a rear most portion of the body portion 134.

The body portion 134 may further include a rear wall 182, as depicts in FIG. 5. The rear wall 182 may be attached to and extend from each of the sidewalls 180*a*, 180*b*, and the top wall 139. In this regard, the rear wall 182, the sidewalls 180*a*, 180*b*, and the top wall 139 may generally cooperate to define an exterior contour of the saw guard 130. The rear wall 182 may define a rear slot 184. The rear slot 184 may be aligned with the slot 146, as described herein. The rear slot 184 may be dimensioned to receive at least a portion of the riving knife 112, for example, to facilitate placement of the saw guard 130 on the riving knife 112 and removal therefrom.

With reference to FIG. 3, the body portion 134 may have an underside 135. The underside 135 may generally be a region of the saw guard 130 that is configured to receive the portion of the saw blade 110 and the riving knife 112. With respect to the guard portion 138, the body portion 134 may define a guard interior contour 137. The guard interior contour 137 may define a guard cavity 136. The saw blade 110 may be arranged at least partially within the guard cavity 136 when the saw guard 130 is attached to the riving knife 112. The guard interior contour 137 may define a shape of the guard cavity to match a shape of at least the portion of the saw blade 110 received therein.

With respect to the attachment portion 142, the underside 135 may include various features to facilitate the attachment of the saw guard 130 to the riving knife 112, including the slot 146. In one example, as shown in FIG. 3, the attachment portion 142 may include a forward attachment section 142*a* and a rear attachment section 142*b*. The forward attachment section 142 may be recessed on the underside 135 of the body portion 134. The rear attachment section 142*b* may define a bottommost or landing surface 186 of the body portion 134 adjacent the forward attachment section 142*a*. The slot 146 may extend along and be defined by each of the forward and rear attachment sections 142*a*, 142*b*. As further shown in FIG. 3, at least the forward attachment section 142*a* may be defined by an attachment body 145. The attachment body 145 may be formed from the same material and be continuous with the remainder of the body portion 134. The attachment body 145 may be seated in and/or fill in a portion of the underside 135, as shown in FIG. 3. An attachment body face 147 may define a transition between the attachment portion 142 and the guard portion 138 at the underside 135. The attachment body face 147 may contoured to match a contour of the saw blade 110. The attachment portion 142 is further shown as including a lip 188 at the rear attachment portion 142*b*. The lip 188 may help extend the landing surface 186 to provide additional stability to the saw guard 130.

Figure 8:
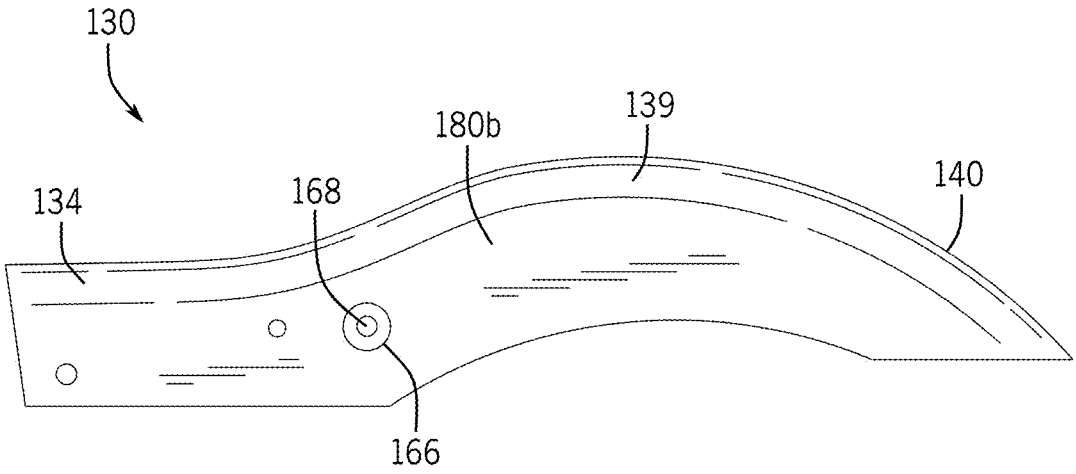
FIG. 8 is a left side elevation view of the saw guard of FIG. 2.
Figure 9:
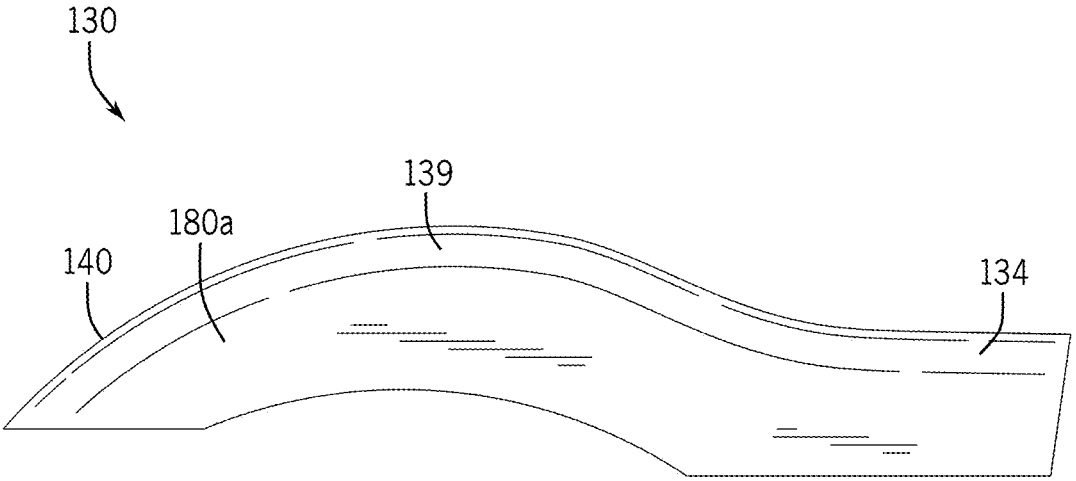
FIG. 9 is a right side elevation view of the saw guard of FIG. 2.
Figure 10:
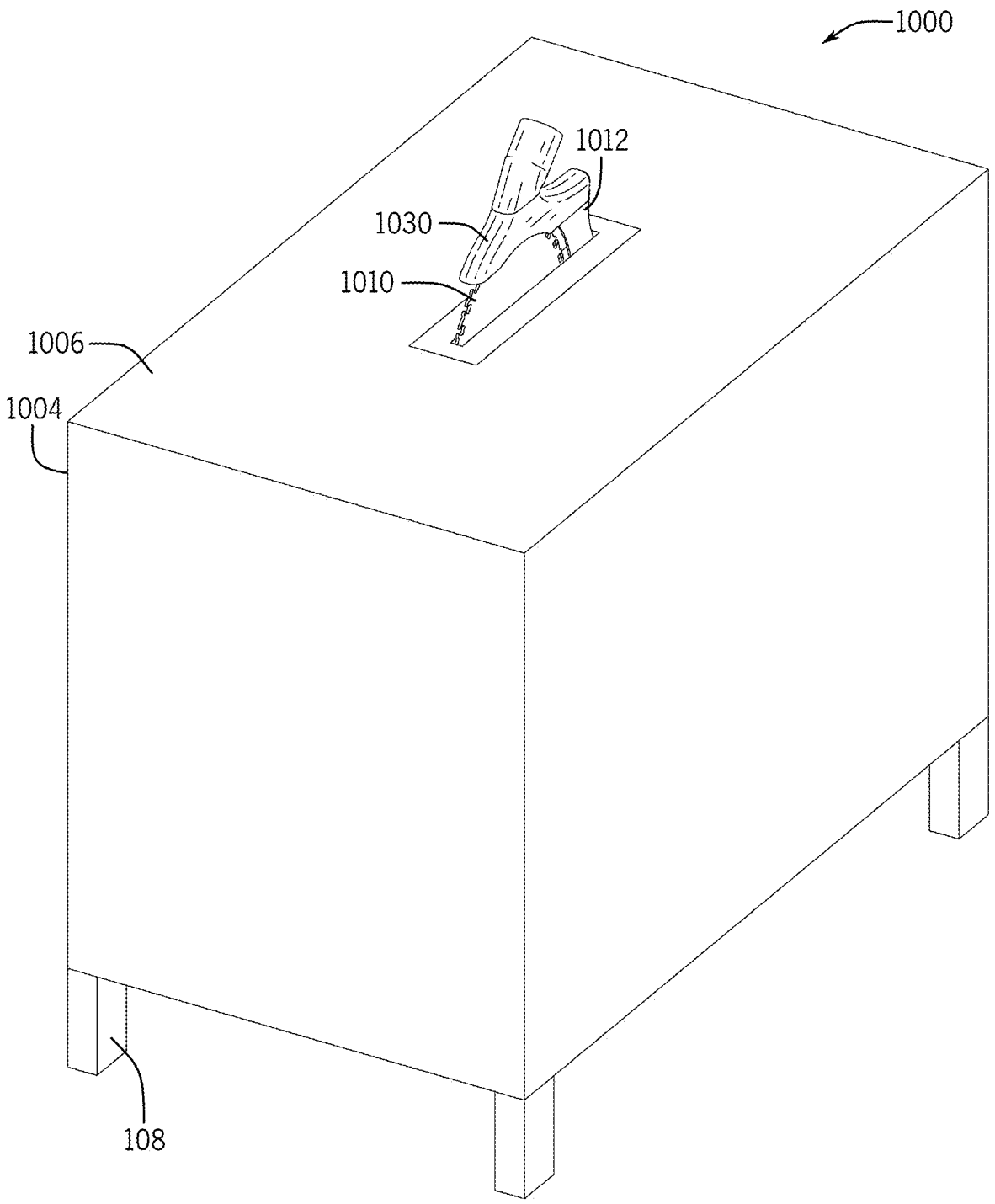
FIG. 10 is an isometric view of a second embodiment of a saw guard connected to a riving knife and saw table.

The body portion 134, as shown in FIG. 3, may also include various openings or holes configured for engagement with components of an attachment assembly or other features that support the releasable attachment of the saw guard 130 with the riving knife 112. As one example, the body portion 134 may include an anchor hole 162, a magnetic component hole 164, an attachment assembly hole 166, and a moveable anchor piece hole 168 (FIG. 8). At least the anchor hole 162 and the moveable anchor piece hole 168 may extend into a thickness of the body portion 134 and into the slot 146.

With further reference to FIG. 3, the saw guard 130 may include a variety of components to facilitate the releasable two-point attachment of the saw guard 130 to the riving knife 112. While many components and configurations are possible and contemplated herein, FIG. 3 shows an anchor piece 150, a magnetic component 152, and an attachment assembly 154. The attachment assembly 154 may include a moveable anchor piece 156, a biasing member 158, and an engagement member 160. The anchor piece 150 may be a substantially cylindrical metal component that is seated in the anchor hole 162 and generally extends across a width $W_s$ of the slot 146. The magnet component 152 may be a substantially cylindrical magnetic component that is seated in the magnetic component hole 164. The magnetic component 152 may be seated in the magnetic component hole 164 such that a portion of the surface of the saw guard 130 had magnetic properties via the magnetic component 152. The moveable anchor piece 156 may be a substantially cylindrical metal component that is seated in the moveable anchor piece hole 168 and generally extends across a width $W_s$ of the slot 146. The biasing member 158 may be a spring, such as helical spring, with the moveable anchor piece extending through the biasing member 158. The engagement member 160 may be attached to the moveable anchor piece 156. The engagement member 160 may be configured to receive a user input on an exterior of the saw guard 130 for manipulation of the moveable anchor piece 156.

Figure 5A:
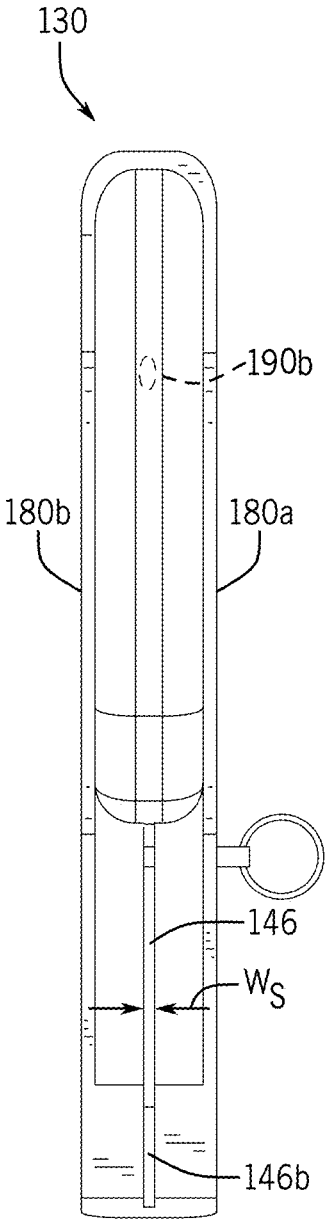
FIG. 5A is a bottom plan view of the saw guard of FIG. 2 in a first configuration.
Figure 5B:
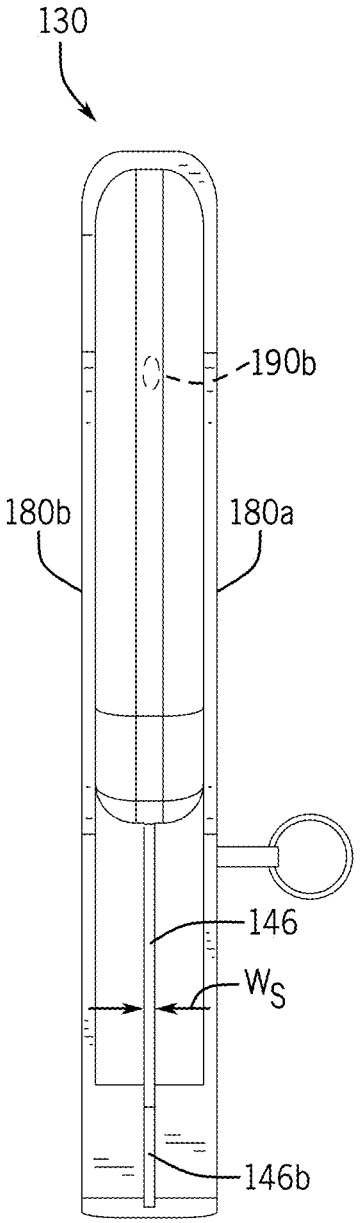
FIG. 5B is a bottom plan view of the saw guard of FIG. 2 in a second configuration.
Figure 6:
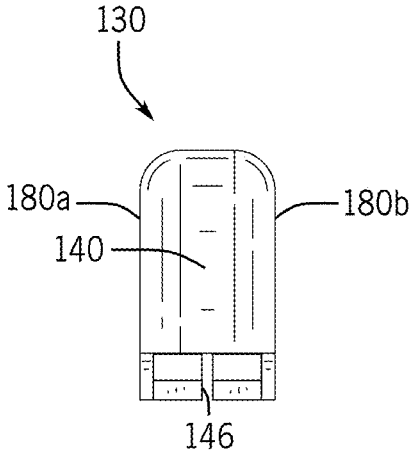
FIG. 6 is a front elevation view of the saw guard of FIG. 2.
Figure 7:
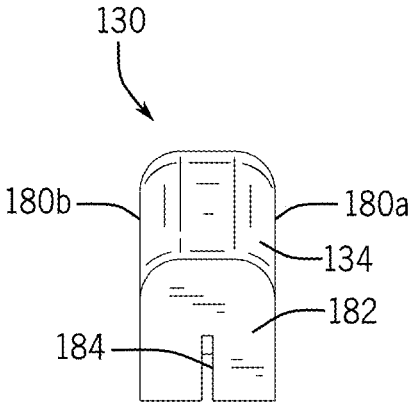
FIG. 7 is a rear elevation view of the saw guard of FIG. 2.

For example, in operation, the biasing member 158 may function to bias the moveable anchor piece 156 toward a first configuration. In the first configuration, the moveable anchor piece 156 may extend substantially entirely across the width $W_s$ of the slot 146, as shown in FIG. 5A. The engagement member 160 may be operable to receive a force input that is configured to overcome the biasing force and move the moveable anchor piece from the first configuration to a second configuration. In the second configuration, the moveable anchor piece may be partially or fully moved from the slot 146, as shown in FIG. 5B. Upon the release of the force input, the biasing member 158 may cause the moveable anchor piece to transition to the first configuration. To facilitate the foregoing, the engagement member 160 may include an optional ring that is securable to a side of the saw guard via the magnetic component 152.

In light of the foregoing, the saw guard 130 may be removably attached to the riving knife 112. For example, the moveable anchor piece 156 may be moved from the first configuration to a second configuration. The riving knife 112 may be advanced into the slot 146. In so doing, the anchor piece 150 may be engaged with the first attachment feature 114*a*. The saw guard 130 may be further manipulated into a desired position relative to the riving knife 112, such as relative to the second attachment feature 114*b*. In turn, the moveable anchor piece 156 may be caused to transition from the second configuration to the first configuration. In so doing, the moveable anchor piece 156 may be engaged with the second attachment feature 114*b*. The saw guard 130 may be released from the riving knife 112 causing the moveable anchor piece to transition from the first configuration to the second configuration again and manipulating the saw guard 130 from the riving knife 112.

In some example configurations, the saw guard 130 may include indicators, lights, a display and/or other electrical components. The electrical components may facilitate one or more operations of the saw guard 130. For example, the electrical components may provide an indication to a user that the saw is in operation, the saw guard 130 is attached to the saw, and/or other function. By way of illustration, FIG. 2 shows the saw guard 130 as optionally including a first light element 190*a*. The first light element 190*a* may be positioned toward or at a front most edge of the saw guard 130. In this manner, the first light element 190*a* may be used to illuminate a working surface forward of the saw guard 130, such as an area of the table which receives a board for cutting. By way of further illustration and with reference to FIG. 5A, a second light element 190*b* is shown. The second light element 190*b* may be arranged within the saw guard 130. This may allow the saw guard 130 to provide illumination to the saw blade and/or the area under the saw guard 130 more generally. It will be appreciated that the first and second light elements 190*a*, 190*b* are shown optionally, and for purposes of illustration. In some cases, more or fewer light elements may be used. Further, the first and second light elements 190*a*, 190*b* and/or any other light elements may be arranged at substantially any position along the saw guard 130 including being arranged in a strip or other fashion to provide illumination along a length of the saw guard 130. The first and second light elements 190*a*, 190*b* may be LEDs. The first and second light elements 190*a*, 190*b* may be connected to an internal power source, such as a battery pack, of the saw guard 130. In some cases, the saw guard 130 may therefore also include a switch or other feature to control an operation of the first and second light elements, such as turning the first and second light elements 190*a*, 190*b* on or off.

With reference to FIGS. 10-18, a system 1000 is disclosed. The system 1000 may be substantially analogous to the system 100 described above in relation to FIGS. 1-9, and include a table saw 1004, a table portion 1006, supports 1008, saw blade 1010, riving knife 1012, and saw guard 1030. The saw guard 1030 may be substantially analogous to the saw guard 130 described above in relation to FIGS. 1-9 and include a cutaway 1033, a body portion 1034, an underside 1035, a guard cavity 1036, a guard interior contour 1037, a guard portion 1038, a top wall 1039, a beveled edge 1040, an attachment portion 1042, a forward attachment section 1042*a*, a rear attachment section 1042*b*, an attachment body 1045, a slot 1046, an attachment body face 1047, an anchor piece 1050, a magnetic component 1052, a moveable anchor piece 1056, a biasing member 1058, an attachment assembly 1054, an engagement member 1060, an anchor hole 1062, a magnetic component hole 1054, an attachment assembly hole 1066, a moveable anchor piece hole 1068, a first side wall portion 1080*a*, a second side wall portion 1080*b*, a rear wall 1082, a rear slot 184, a landing surface 1086, and a lip 1088. Redundant explanation of which is omitted herein for clarity.

Notwithstanding the foregoing similarities, the saw guard 1030 may include a vacuum portion 1070. The vacuum portion 1070 may be a portion of the saw guard 1030 that is configured for attachment with a vacuum system, such as a system including one or more vacuum tubes. A given vacuum tube may be engaged with the vacuum portion 1070 and used to extract dust and other debris from the saw guard 1030.

To facilitate the foregoing, the vacuum portion 1070 may extend from the guard portion 1038. For example, the vacuum portion 1070 and the guard portion 1038 may be components of a one-piece or integrally formed structure, as described herein. The vacuum portion 1070 may have a hollow interior volume that extends from the guard cavity 1036. In this regard, the vacuum portion 1070 may cooperate with the guard portion 1036 to define a path for dust and debris to travel for exit from the saw guard 1030.

Figure 11:
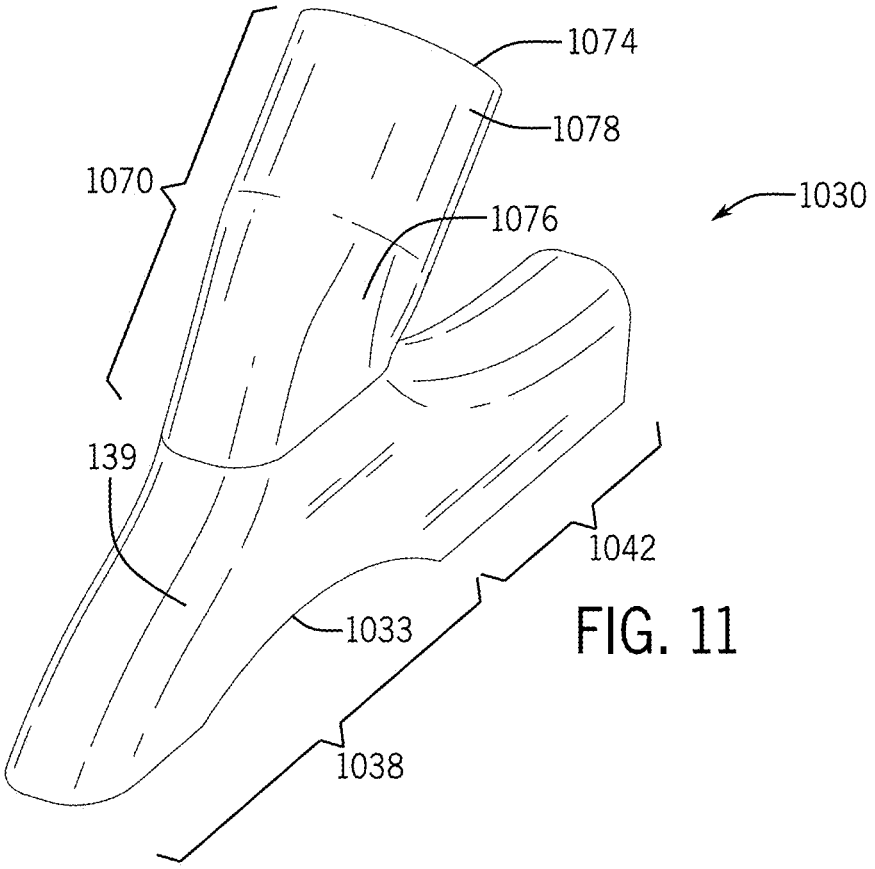
FIG. 11 is a top isometric view of the saw guard of FIG. 10 with the riving knife and saw table removed.
Figure 12:
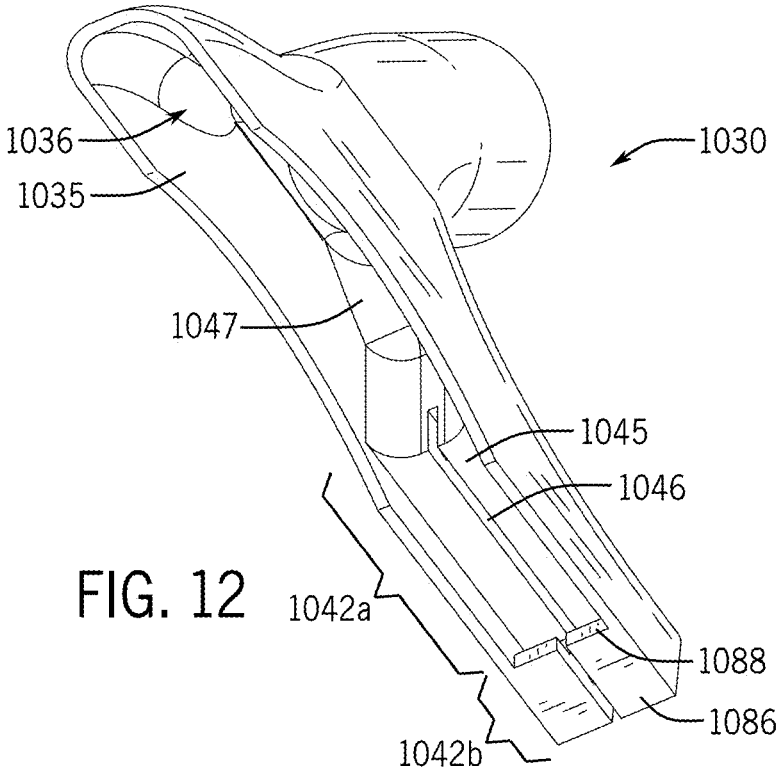
FIG. 12 is a bottom isometric view of the saw guard of FIG. 11.
Figure 13:
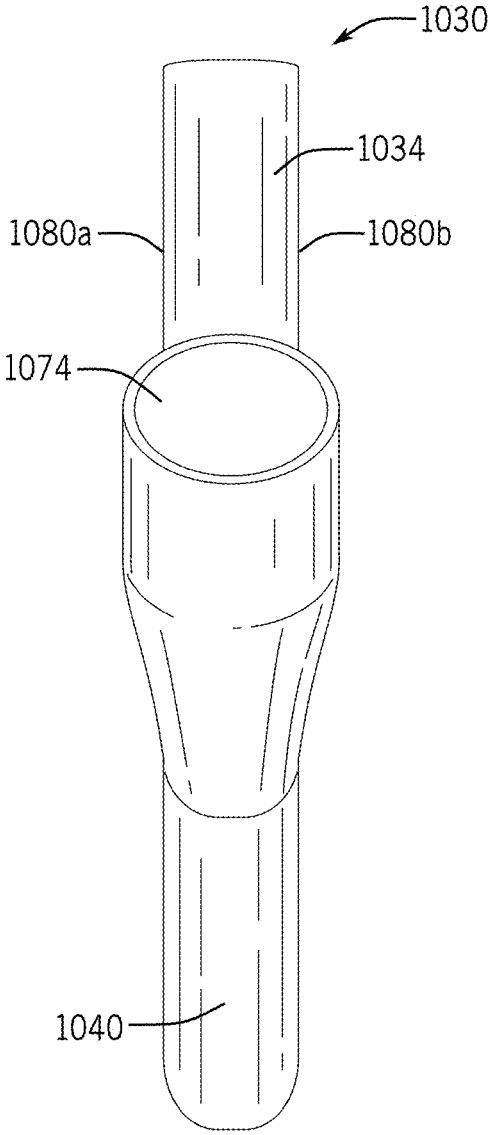
FIG. 13 is a top plan view of the saw guard of FIG. 10.
Figure 14:
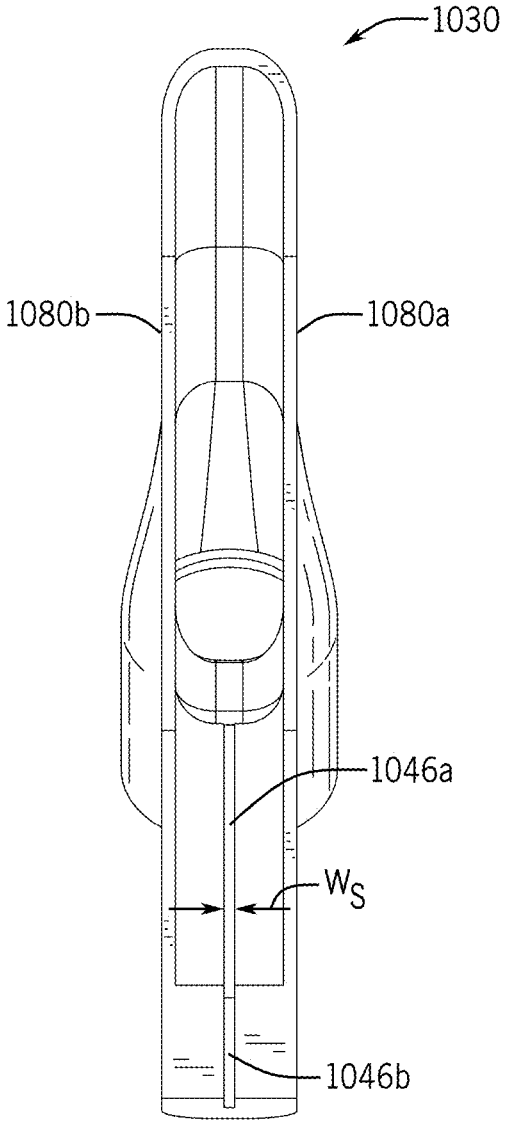
FIG. 14 is a bottom plan view of the saw guard of FIG. 10.
Figure 15:
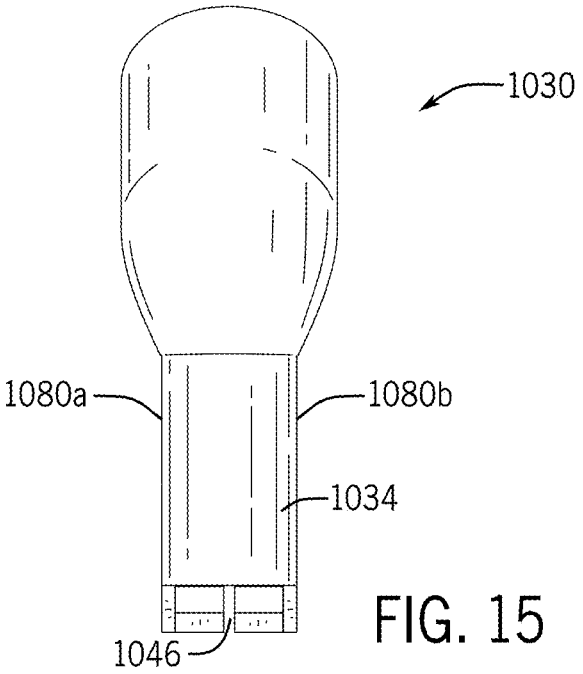
FIG. 15 is a front elevation view of the saw guard of FIG. 10.
Figure 16:
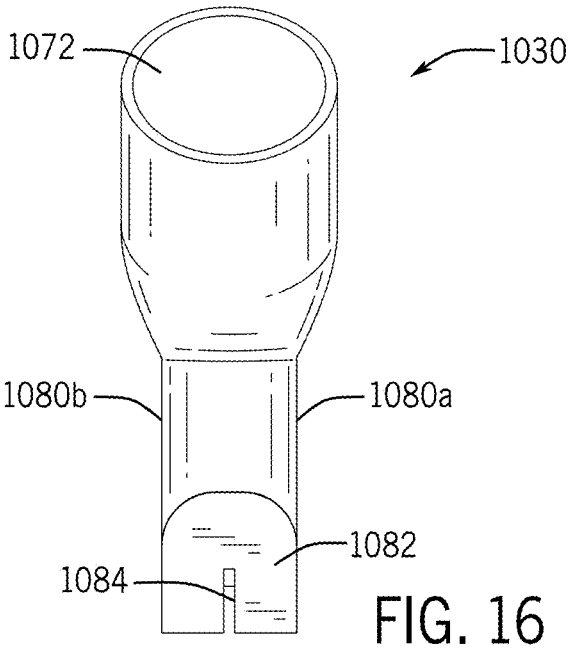
FIG. 16 is a rear elevation view of the saw guard of FIG. 10.
Figure 17:
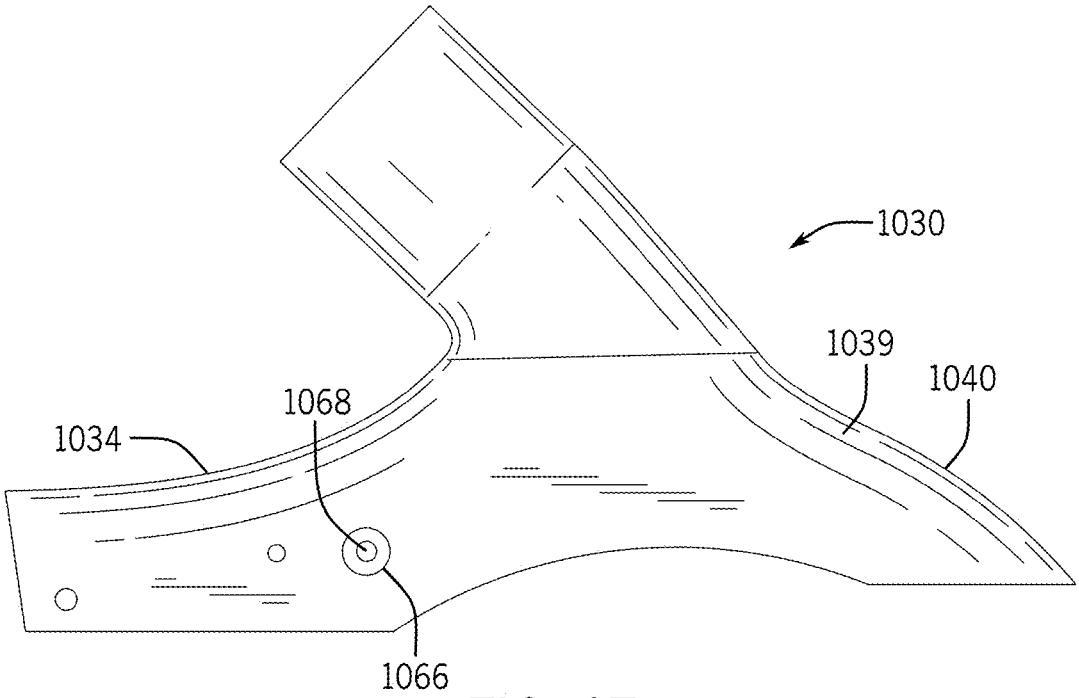
FIG. 17 is a left side elevation view of the saw guard of FIG. 10.
Figure 18:
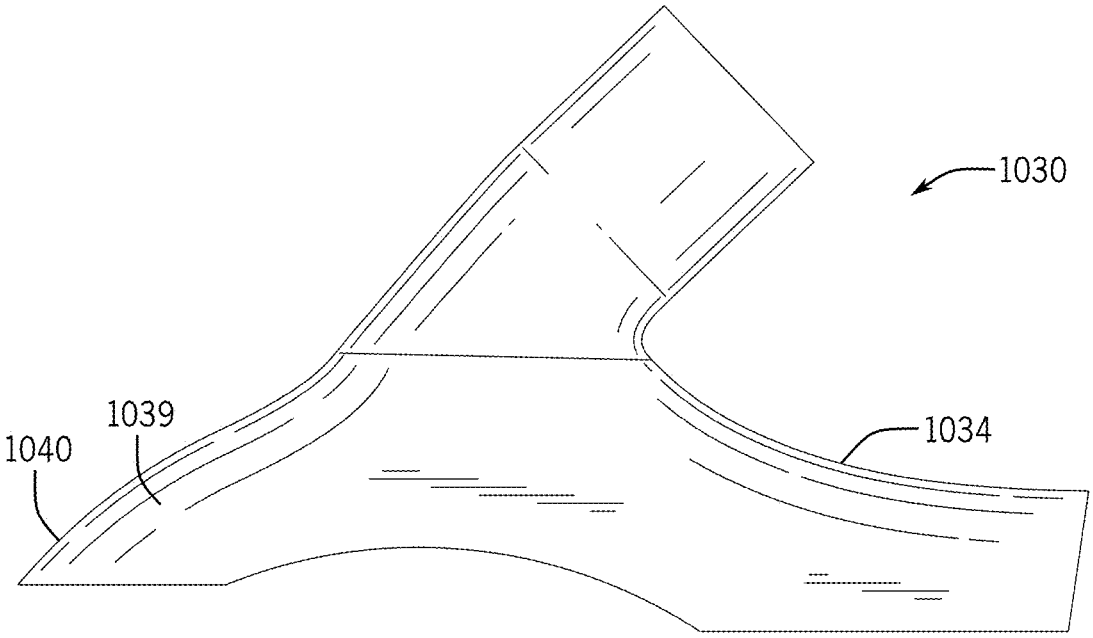
FIG. 18 is a right side elevation view of the saw guard of FIG. 10.

Accordingly, the vacuum portion 1070 is shown in FIG. 11 as defining an exit 1072 for dust and other debris produced in the guard cavity 1036 by operation of the saw blade 1010, as shown in FIG. 11. As further shown in FIG. 11, the vacuum portion 1070 may include a transitional section 1076 and a cylindrical section 1078. The cylindrical section 1078 may define a cylindrical opening 1074 at the end most portion of the cylindrical section 1078. The cylindrical opening 1074 may have a size and shape that is configured for attaching the vacuum portion 1070 with a tubing of a vacuum system. The transitional section 1076 may geometrically transition the vacuum portion 1070 from the cylindrical section 1078, which is in the shape of cylinder in order to receive a tube to a shape of the guard portion 1036 of the saw guard 1030. As one example, the cylindrical opening 1074 may have a size and shape that is configured to define a friction fit with a vacuum tubing. In other examples, other shapes and sizes of the vacuum portion 1070 are possible and contemplated herein.

Figure 19:
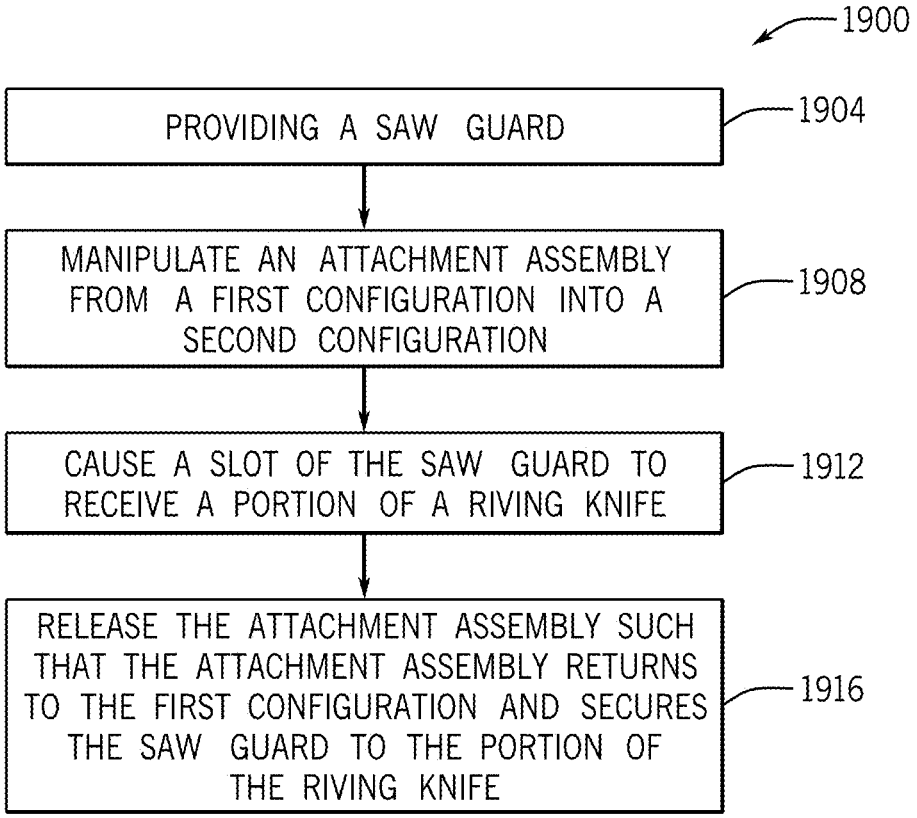
FIG. 19 is a flow diagram of attaching a saw guard to a riving knife of a table saw.

To facilitate the reader's understanding of the various functionalities of the embodiments discussed herein, reference is now made to the flow diagram in FIG. 19, which illustrates process 1900. While specific steps (and orders of steps) of the methods presented herein have been illustrated and will be discussed, other methods (including more, fewer, or different steps than those illustrated) consistent with the teachings presented herein are also envisioned and encompassed with the present disclosure.

At operation 1904, a saw guard is provided. For example, and with reference to FIGS. 1-9, the saw guard 130 may be provided. In other cases, and with reference to FIGS. 10-18, the saw guard 1030 may be provided. The saw guard 1030 may be provided in application in which the vacuum portion 1070 of the saw guard 1030 is desired, for example, to remove dust and debris from the guard cavity 1036.

At operation 1908, an attachment assembly is manipulated from a first configuration into a second configuration. For example, and with reference to FIGS. 3A-5B, the attachment assembly 154 may be manipulated from a first configuration (e.g., as shown in FIG. 5A) to a second configuration (e.g., as shown in FIG. 5B). To facilitate the foregoing, the engagement member 160 may be pulled in order to move the moveable anchor piece 156. The moveable anchor piece 156 may be moved entirely out of the slot 146, as shown in FIG. 5B.

At operation 1912, a slot of the saw guard is caused to receive a portion of the riving knife. For example, and with reference to FIGS. 1B-3B, the slot 146 may be caused to receive the riving knife 112. For example, the moveable anchor piece 156 may be removed sufficient from the slot 146 to allow for the advancement of the riving knife 112 into the slot 146. The riving knife 112 may be advanced into the slot 146 such that the first and second attachment features 114*a*, 114*b* are engaged or engageable with the anchor pieces 150, 156.

At operation 1916, the attachment assembly is released such that the attachment assembly returns to the first configuration and secures the saw guard to the portion of the riving knife. For example, and with reference to FIGS. 3A-5B the attachment assembly 154 may be manipulated from the second configuration (e.g., as shown in FIG. 5B) to the first configuration (e.g., as shown in FIG. 5A). To facilitate the foregoing, the engagement member 160 may be released from a pulled state in order to move the moveable anchor piece 156 to the first configuration. The transition of the moveable anchor piece 156 to the first configuration may cause the moveable anchor piece to engage one of the attachment features 114*a*, 114*b* of the riving knife 112. Upon the engagement of the movable anchor piece 156 with the attachment features 114*a*, 114*b*, the saw guard 130 may define a two-point attachment with the riving knife 112. The two-point attachment may stabilize and secure the saw guard 130 relative to the riving knife 112.

Other examples and implementations are within the scope and spirit of the disclosure and appended claims. For example, features implementing functions may also be physically located at various positions, including being distributed such that portions of functions are implemented at different physical locations. Also, as used herein, including in the claims, "or" as used in a list of items prefaced by "at least one of" indicates a disjunctive list such that, for example, a list of "at least one of A, B, or C" means A or B or C or AB or AC or BC or ABC (i.e., A and B and C). Further, the term "exemplary" does not mean that the described example is preferred or better than other examples.

The foregoing description, for purposes of explanation, uses specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A saw guard for attachment to a riving knife of a table saw, the saw guard comprising:

an integrally formed body portion having an elongated shape and defining:

a guard portion configured to cover a portion of a saw blade, the guard portion including:

a top wall having an interior contour and an exterior contour shaped to match a shape of the portion of the saw blade, a pair of sidewalls extending downward from the top wall, and wherein the interior contour and sidewalls define a guard cavity to receive the portion of the saw blade, the guard cavity having a first width defined by the top wall;

an attachment portion, the attachment portion extending from the guard portion and defining a slot extending from the guard cavity, the slot configured to receive a portion of the riving knife and having a second width, the second width less than the first width, and wherein the attachment portion further defines an anchor aperture, an attachment assembly aperture, and a magnetic compound aperture;

an anchor piece connected to the body portion and arranged at least partially in the slot;

an attachment assembly connected to the body portion and arranged at least partially in the slot and separated from the anchor piece, the attachment assembly comprising:

a moveable anchor piece, a biasing member configured to bias the moveable anchor piece to a first configuration, and an engagement member configured to assist manipulation of the moveable anchor piece; and wherein in the first configuration, the anchor piece and the attachment assembly define a two-point attachment between the saw guard and the riving knife, and in a second configuration, the attachment assembly permits release of the saw guard from the riving knife; and a magnetic compound inserted into the magnetic compound aperture secures the engagement member when the attachment assembly is in the first configuration.

2. A saw guard for attachment to a riving knife of a table saw, the saw guard comprising:

a body portion having an elongated shape and defining:

a guard portion defining a guard cavity having a first width and configured to cover a portion of a saw blade, an attachment portion, the attachment portion extending from the guard portion and defining: a slot extending from the guard cavity, the slot configured to receive a portion of the riving knife and having a second width, the second width less than the first width, and wherein:

the guard portion further comprises:

a top wall having an interior contour and an exterior contour shaped to match a shape of the portion of the saw blade, a pair of sidewalls extending downward from the top wall at an angle perpendicular to the saw blade and wherein the sidewalls form a continuous sidewall for both the guard portion and the attachment portion, and a rear wall attached to each sidewall and defining a first end of the slot, and the attachment portion further defines an anchor aperture, an attachment assembly aperture, and a magnetic compound aperture;

an anchor piece connected to the body portion and arranged at least partially in the slot, wherein the anchor piece is a cylindrical component;

an attachment assembly connected to the body portion and arranged at least partially in the slot and separated from the anchor piece, the attachment assembly comprising:

a moveable anchor piece, a biasing member configured to bias the moveable anchor piece to a first configuration, an engagement member configured to assist manipulation of the moveable anchor piece, and wherein:

in the first configuration, the anchor piece and the attachment assembly define a two-point attachment between the saw guard and the riving knife, and in a second configuration, the attachment assembly permits release of the saw guard from the riving knife;

a magnetic compound inserted into the magnetic compound aperture secures the engagement member when the attachment assembly is in the first configuration; and wherein the guard portion and attachment portion are integrally formed with the body portion.

3. The saw guard of claim 2, wherein in the first configuration, the moveable anchor piece extends across the second width of the slot, and in the second configuration, the moveable anchor piece is moved such that the slot is free of the moveable anchor piece.

4. The saw guard of claim 2, wherein the engagement feature is connected to the moveable anchor piece and configured to receive a user input that overcomes a biasing force of the biasing member and permits the movement of the moveable anchor piece from the first configuration to the second configuration.

5. The saw guard of claim 2, wherein the slot is defined extending in an elongated direction along an underside of the body portion.

6. The saw guard of claim 5, wherein the attachment portion comprises a forward attachment section recessed on the underside of the body portion, and a rear attachment section defining a bottommost surface of the body portion adjacent the forward attachment section, and the slot is defined extending along the forward attachment section and the rear attachment section.

7. The saw guard of claim 6, wherein the anchor piece extends across the second width of the slot at the rear attachment section.

8. The saw guard of claim 7, wherein the moveable anchor piece extends across a width of the slot at the forward attachment section.

9. The saw guard of claim 2, wherein the body portion defines, at the guard portion, an outer contoured surface configured to match a generally circular shape of the saw blade.

10. The saw guard of claim 9, wherein the outer contoured surface includes a beveled surface extending along the generally circular shape of the saw blade.

11. The saw guard of claim 2, wherein the body portion further defines a vacuum portion extending from an aperture defined by the guard portion and extending through the guard portion and configured to define an exit for dust produced in the guard cavity by operation of the saw blade.

12. The saw guard of claim 11, wherein the vacuum portion is configured for attachment with tubing of a vacuum system.

13. The saw guard of claim 12, wherein the vacuum portion defines a substantially cylindrical opening configured to receive a tube of the vacuum system.

14. The saw guard of claim 13, wherein the vacuum portion is configured to form a friction fit with the tube of the vacuum systems received in the substantially cylindrical opening.

15. A system comprising the saw guard of claim 2, and a gauge configured to define a separation between the saw guard and a table of the table saw.

16. The system of claim 15, wherein the gauge comprises a lip configured to contact the saw guard and set a clearance between the saw guard and the table saw.

17. The system of claim 15, wherein the riving knife comprises a first attachment feature configured to receive the anchor piece and a second attachment feature configured to receive the moveable anchor piece of the attachment assembly.

18. The system of claim 17, wherein the first and second attachment features are defined by grooves extending through a thickness of the riving knife.

* * * * *